US005687424A

United States Patent [19]

Masley

[11] Patent Number: 5,687,424

[45] Date of Patent: Nov. 18, 1997

[54] HAND COVERING HAVING ANATOMICALLY SHAPED FINGER TIP

[75] Inventor: Francis J. Masley, Wilmington, Del.

[73] Assignee: W. L. Gore & Associates, Inc., Newark, Del.

[21] Appl. No.: 661,270

[22] Filed: Jun. 10, 1996

[51] Int. Cl.[6] ..... A41D 19/00

[52] U.S. Cl. ..... 2/163; 2/161.6; 2/168

[58] Field of Search ..... 2/21, 163, 169, 2/168, 161.7, 161.6, 159, 161.1

[56] References Cited

U.S. PATENT DOCUMENTS

| | | | |
|---|---|---|---|
| 628,017 | 7/1899 | Murphy | 2/163 |
| 1,066,480 | 7/1913 | Finlay . | |
| 1,074,351 | 9/1913 | Carson | 2/163 |
| 1,294,105 | 2/1919 | Holden . | |
| 2,056,555 | 7/1936 | Auster et al. | 2/163 |
| 2,075,550 | 2/1937 | Smith | 2/168 |
| 2,226,716 | 3/1940 | Robertson | 2/168 |
| 2,725,570 | 12/1955 | Penna | 2/163 |
| 2,736,034 | 2/1956 | Fredenhagen et al. | 2/163 |
| 4,189,787 | 2/1980 | Stansbury | 2/163 |
| 4,460,113 | 7/1984 | Nicklous | 223/101 |
| 4,507,807 | 4/1985 | Karkanen | 2/161 R |
| 4,590,626 | 5/1986 | Chen | 2/169 |
| 4,654,896 | 4/1987 | Rinehart | 2/163 |
| 4,694,508 | 9/1987 | Iriyama et al. | 2/21 |
| 4,694,843 | 9/1987 | Casenhiser | 2/21 |
| 4,785,479 | 11/1988 | Watanabe | 2/163 |
| 4,852,586 | 8/1989 | Haines | 128/842 |
| 4,881,277 | 11/1989 | Hogle | 2/169 |
| 4,908,881 | 3/1990 | Field | 2/21 |
| 4,924,530 | 5/1990 | Tagaya | 2/168 |
| 5,020,162 | 6/1991 | Kersten et al. | 2/164 |
| 5,036,589 | 8/1991 | Heinrich | 30/298 |
| 5,070,543 | 12/1991 | Beck | 2/163 |
| 5,187,815 | 2/1993 | Stern et al. | 2/161 R |
| 5,428,841 | 7/1995 | Stein | 2/163 |

*Primary Examiner*—Amy B. Vanatta
*Attorney, Agent, or Firm*—Victor M. Genco, Jr.

[57] ABSTRACT

An improved hand covering is provided of the type having an index finger stall, a thumb stall, a dorsal portion and a palm portion. The hand covering is provided with at least one index finger covering having an upper portion, an arching transition section to a lower portion, and a ridge formed at the union of the upper and lower portion. The index finger covering is dimensioned to resemble a human index finger tip. A thumb covering may also be provided which has an upper section, an arching transition section to a lower portion, and a ridge formed at the union of the upper and lower portion. The thumb covering is dimensioned to resemble a human thumb tip. The hand covering provides a wearer with improved dexterity and tactility, thereby, allowing the wearer, for example, to pick up or manipulate small objects and perform fine motor skill movements.

20 Claims, 6 Drawing Sheets

HAND COVERING HAVING ANATOMICALLY SHAPED FINGER TIP

FIELD OF THE INVENTION

This invention generally relates to hand coverings. More particularly, the present invention relates to an improved hand covering having anatomically shaped finger tip portions which provide improved tactility and dexterity.

BACKGROUND OF THE INVENTION

Conventional hand coverings and gloves tend to diminish a wearer's ability to grasp, handle and manipulate small objects or perform movements requiring fine motor skills. The loss of these abilities is referred to as a loss in tactility, relating to the sense of touch of the finger tips, and a loss in dexterity, relating to flexibility of the fingers and the entire hand. Typically, glove thickness is directly related to a loss of tactility and dexterity. Tactility and dexterity have traditionally been improved by employing thin glove constructions or by treating the surface of the gloves with a sticky or gripping type of material, such as a low modulus polymer coating applied to the outer surface of the glove finger and palm areas, for example. These coatings, however, exhibit shortcomings when applied to gloves over 10 mils thick.

New uses of gloves require improved tactility and dexterity. For example, military aircraft and ground warfare vehicles employ sensitive instrumentation panels having delicate toggle switches and closely spaced buttons and controls which require precise manipulation. Often, an operator must activate one control, while not activating an adjacent control. Such controls and switches may be located in a recess or in a position wherein the operator must determine, by feel, if the switch or control is activated or located in the correct position. However, conventional gloves, having seams disposed across a finger tip portion, may allow the seam to roll between the operator's finger and the control or switch, thereby preventing accurate determination of the switch's position. Further, conventional gloves may require a user to compact insulation between the finger tip and the end most portion of the glove finger to "feel" the position of a control, thereby causing superfluous glove material to bunch at the tip of the finger and contact adjacent controls.

Improved glove tactility and dexterity may also aid, for example, in operating radio equipment, paging through flight manuals, opening and closing fasteners on clothing garments, operating outdoor equipment such as a ski boot buckle or fishing reel, grasping writing instruments, tying knots, handling firearms and performing various other fine motor skill movements.

Gloves having a thickness in excess of about 10 mils, insulated gloves, and/or relatively inelastic gloves often lose their ability to maintain a shape similar to the shape of a finger tip thereby reducing tactility or dexterity. Furthermore, conventional glove constructions often restrict the ability of a wearer's digits to precisely bend or flex. Such glove constructions compromise optimal finger tip shape and flexibility, thereby significantly detracting from optimal tactility and dexterity characteristics.

Several attempts have been made to provide improved tactility and dexterity, however, any successes have been limited. For example, U.S. Pat. No. 4,507,807 discloses a work glove finger structure made of a pliable and durable material to increase tactility, wherein the material is stretched over the finger tip. A high friction band keeps the material structure on the tip of the finger, however, the finger structure has no specifically designed shape.

U.S. Pat. No. 1,066,480 discloses a finger or finger stall made of rubber which comprises artificial projecting finger nails, undercut ribs on the index finger and a second artificial nail on the fleshy inner part of the thumb. The finger structure has no specifically designed shape.

U.S. Pat. No. 2,075,550 and U.S. Pat. No. 4,189,787 disclose a dipped rubber glove and dipped latex glove, respectively, having a unitary construction and exemplify many shortcomings of the prior art. Other glove structures to improve fit comfort, as opposed to glove performance, have included the provision of reduced diameters, cylindrical finger tip areas (U.S. Pat. No. 2,266,716), fingernail pockets (U.S. Pat. No. 2,056,555), and naturally bent fingers (U.S. Pat. No. 1,294,105).

U.S. Pat. No. 4,908,881 discloses a finger guard for protection and aesthetic coverage of an injured finger, but does not relate to gloves or to providing improved tactility and dexterity in glove constructions.

Prior glove constructions and digital coverings may have been useful in some applications, however they remain replete with shortcomings that detract from their usefulness in more demanding applications which require a high degree of tactility and dexterity.

The foregoing illustrates limitations known to exist in present glove constructions. Thus, it is apparent that it would be advantageous to provide an improved anatomical finger tip covering directed to overcoming one or more of the limitations set forth above. Accordingly, a suitable alternative is provided including features more fully disclosed hereinafter.

SUMMARY OF THE INVENTION

The present invention advances the art of hand coverings beyond which is known to date. In one aspect of the present invention, an improved hand covering is provided of the type having an index finger stall, a thumb stall, a palm portion, and a dorsal portion. The improved hand covering has fixedly attached thereto at least one index finger covering having an upper portion, an arching transition section to a lower portion, and a ridge formed at the union of the upper and lower portion. The index finger covering is dimensioned to resemble a human index finger tip. A thumb covering may also be provided which has an upper section, an arching transition section to a lower portion, and a ridge formed at the union of the upper and lower portion. The thumb covering is dimensioned to resemble a human thumb tip. The hand covering provides a wearer with improved dexterity and tactility, thereby, allowing the wearer, for example, to pick up or manipulate small objects and perform fine motor skill operations.

It is, therefore, a purpose of the present invention to provide an improved hand covering having an anatomically shaped index finger tip covering to allow a covered index finger to function more like an uncovered index finger.

It is another purpose of the present invention to provide an improved hand covering having anatomically shaped finger tip coverings wherein the coverings allow the wearer to better perform movements requiring fine motor skills.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
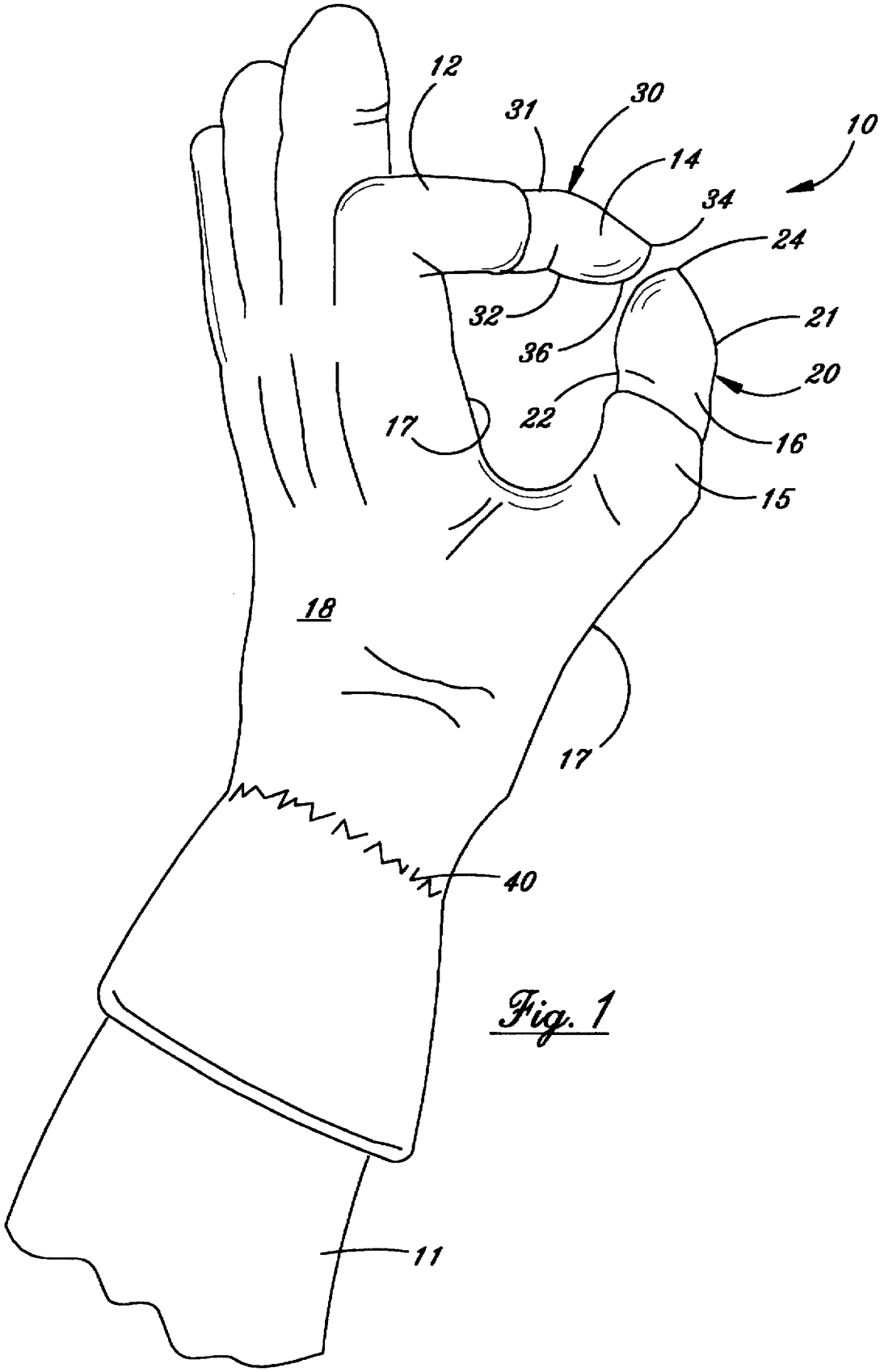
FIG. 1 is a view of one embodiment of the present invention shown donned on a human hand, wherein a thumb and an index finger are flexed in a separated pinching orientation.
Figure 2:
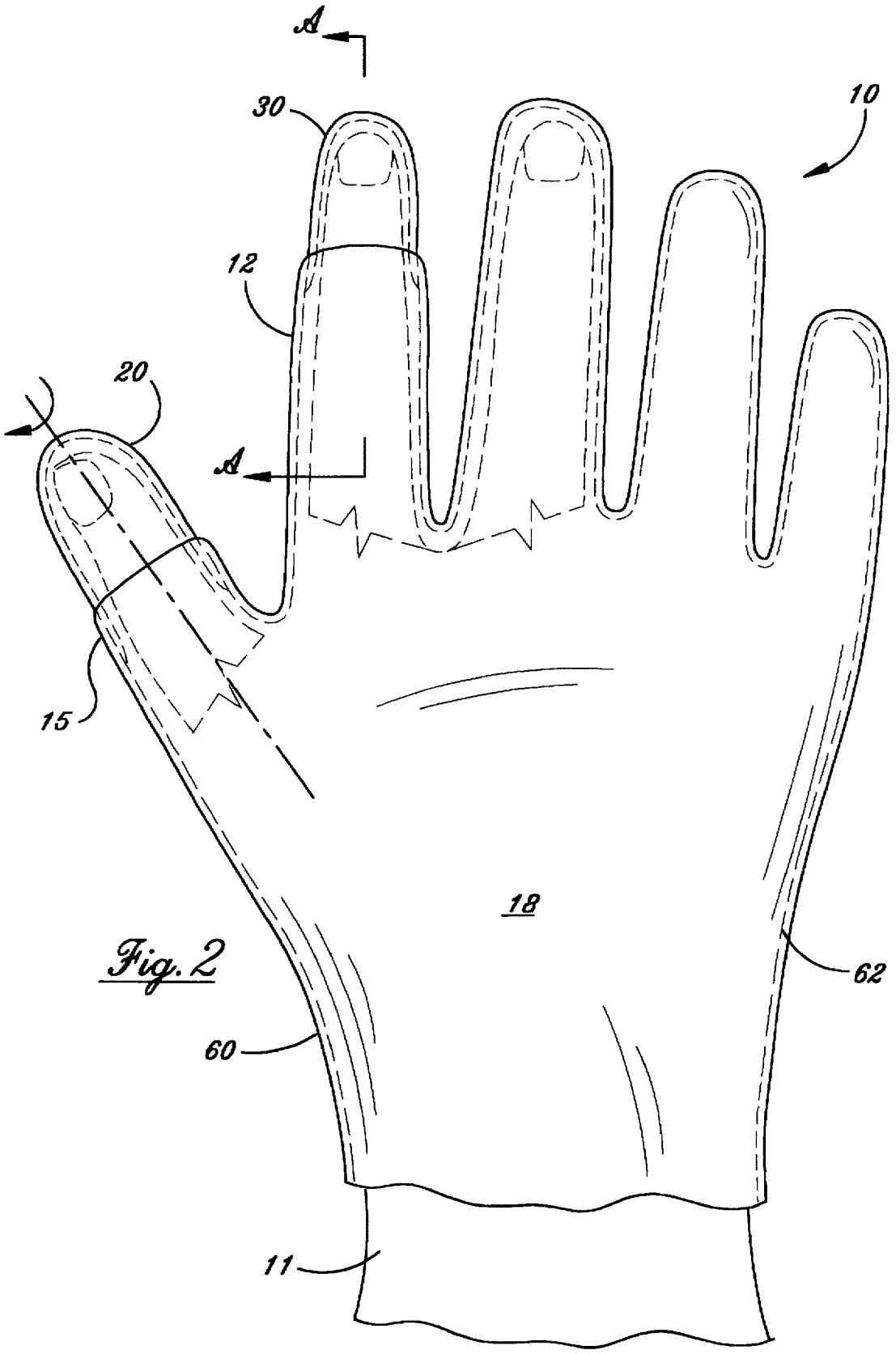
FIG. 2 is a view of one embodiment of the present invention shown donned on a human hand, wherein the hand is disposed in a flat, palm away orientation.
Figure 3:
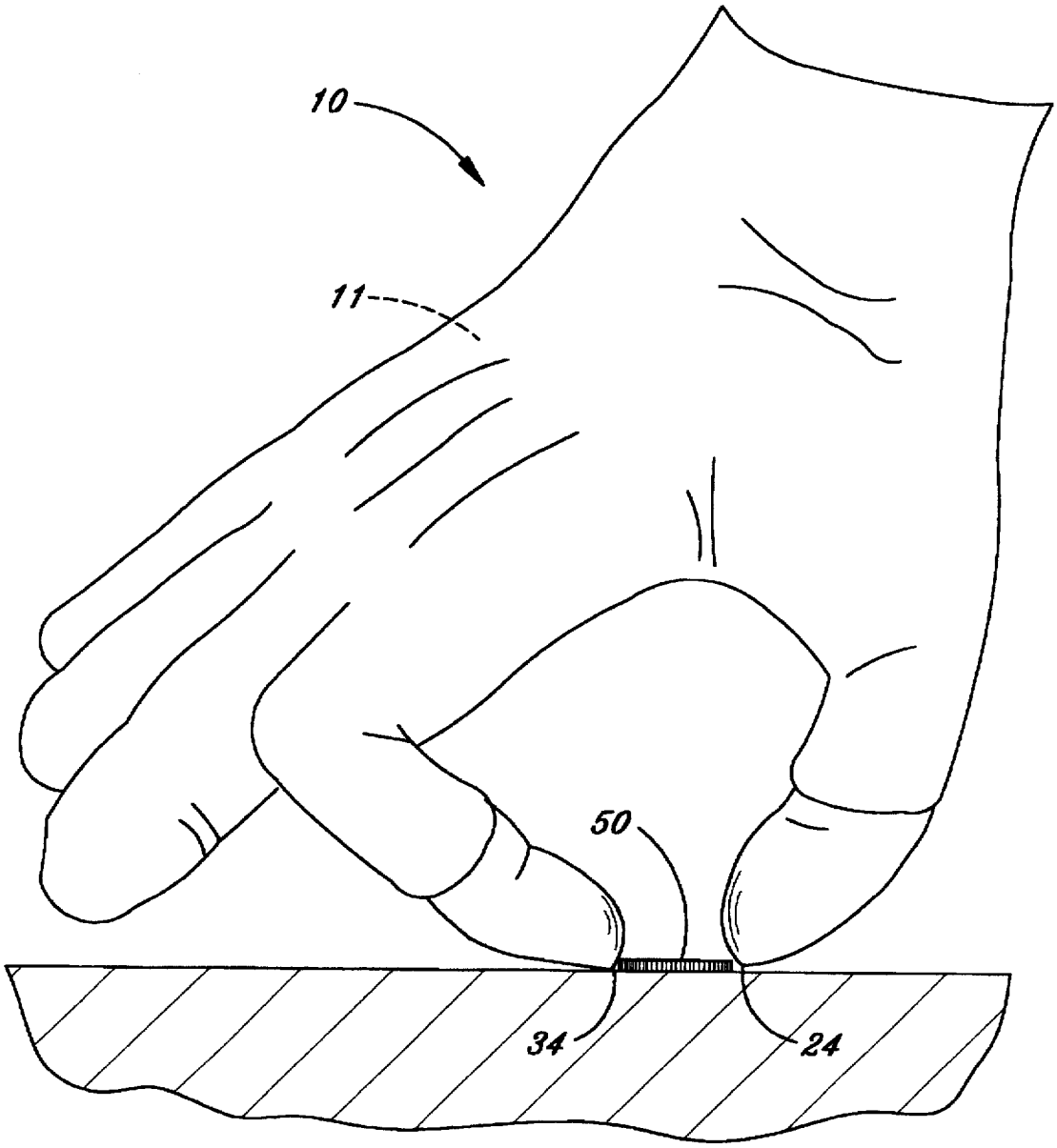
FIG. 3 is an environmental view of a hand covering in accordance with the present invention shown picking up a coin from a flat surface.

Referring now to the drawings, wherein similar reference characters designate corresponding parts throughout the several views, the hand covering of the present invention is generally illustrated at 10 in FIGS. 1, 2 and 3. The inventive hand covering includes at least one index finger stall 12, a thumb stall 15, a palm portion 17, a dorsal portion 18, and at least an index finger covering 30. A thumb covering 20 may also be provided in an alternate embodiment of the present invention.

As shown in FIG. 1, the hand covering 10 is adapted to receive a human hand 11. An index finger of hand 11 is inserted into an index finger stall 12. In an embodiment of the present invention wherein a thumb covering 20 is provided, a thumb is inserted into a thumb stall 15. The palm portion 17 is correspondingly dimensioned to a human palm, while the dorsal portion 18 is correspondingly dimensioned to the dorsal portion of a human hand. Although the hand covering 10 is illustrated as a conventional glove system, in the sense that it includes an individual finger stall for each finger of a human hand and a thumb stall, the teachings of the present invention may be applied to other hand coverings having less than four finger stalls, but at least one index finger stall. Additionally, the hand covering 10 may be provided with an elastically yielding area proximate a wrist portion 40 to provide close contact of the hand covering to a wearer's wrist.

Figure 4B:
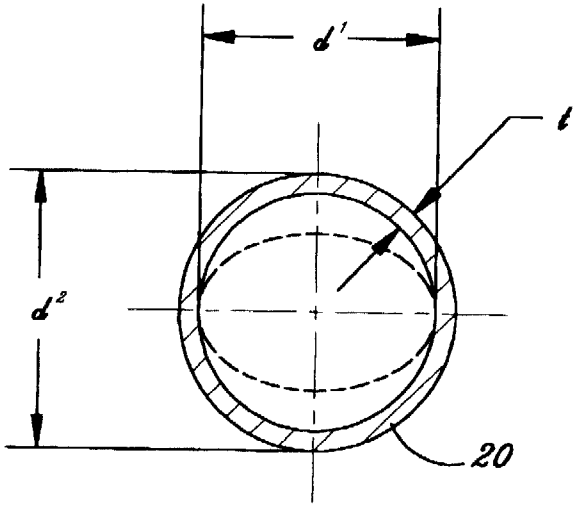
FIGS. 4A and 4B are detailed views of an index finger covering in accordance with the teachings of the present invention.
Figure 4A:
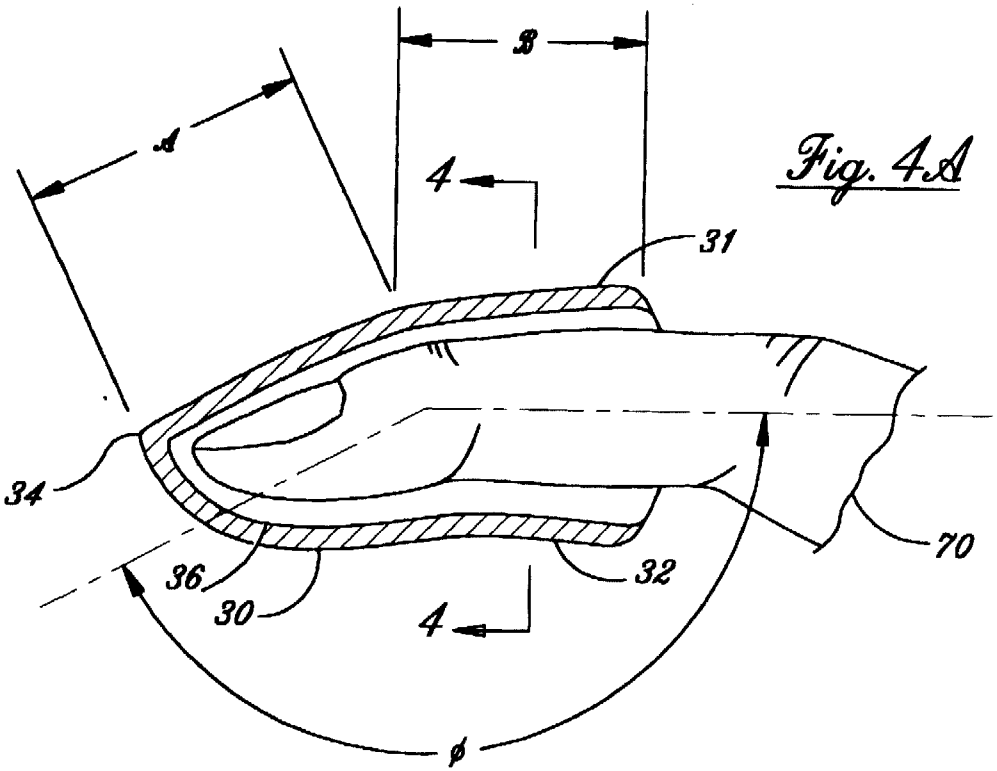

As best seen by reference to FIGS. 4A and 4B, the index finger covering 30 has an upper portion 31 and a lower portion 32. A ridge 34 is formed at the intersection of the lower portion 32 and the upper portion 31. The lower portion 32 curves upward at an arching transition section 36 that approximates the shape of the fleshy part of a human index finger. In an embodiment of the present invention having a thumb covering, the thumb covering has an upper portion and a lower portion. A ridge is formed at the intersection of the upper and lower portion of the thumb covering. The lower thumb covering portion curves upward at an arching transition section that approximates the shape of a human thumb.

FIG. 2 illustrates a preferred embodiment of the present invention wherein the improved hand covering of the present invention is shown disposed over a human hand 11. The human hand 11 is disposed in a flat, palm away orientation. A thumb covering 20 and an index finger covering 30 are made integral with the hand covering 10 at the thumb stall 15 and the finger stall 12 for the index finger respectively.

In military anthropometric data, the thumb and index finger are referred to as digits #1 and #2, respectively. As can be seen by comparatively viewing digits #3, #4 and #5 with digits #1 and #2, in FIG. 2, excess bulk is created by a glove shell 60 having seams 62. This excess bulk reduces tactility and dexterity in digits #3, #4 and #5. Thumb covering 20 and index finger covering 30 significantly improve tactility and dexterity in digits #1 and #2. The thumb covering 20 may be intentionally rotated such that it will directly oppose index finger covering 30. More particularly, when viewing the bare digits #1 and #2 of the human hand while these digits are touching at tip portions, it is known that the thumb (digit #1) does not cooperatively align with the index finger (digit #2). This situation may be remedied by the hand covering of the present invention by rotating the thumb covering 20 such that it aligns with the index finger covering 30. This rotation can range from zero to ninety degrees, with a preferable rotation being 45 degrees.

FIG. 4A shows an index finger covering 30 cut in half along a longitudinal (or central) axis of an index finger 70. Length "A" is an inside length dimension of an outermost phalange portion of the index finger covering. For index finger covering 30, length A may be from about ¾" to 1½". For thumb covering 20 (not shown), length A may be from about 1" to 2". Length "B" is a length dimension of a portion of the finger covering 30 which covers the middle phalange of the finger 70 and the base phalange of a thumb (not shown). For both the thumb covering 20 and index finger covering 30, length B equals a length ¼ to 1 times the dimension of length A.

As best seen by reference to FIG. 4A, angle "ø" is defined between the longitudinal (or central) axis of an index finger 70, or thumb (not shown), and an axis which is substantially parallel to the outermost phalange portion of the index finger covering 30, or thumb (not shown). Angle "ø" may range from a value of about 120° to about 170°. A preferred angle ø value is 150° for a men's large hand covering size. Angle "ø" serves two important purposes. The first purpose is to facilitate keeping either the thumb covering 20 or the finger covering 30 securely located at the tip of either a thumb or finger, respectively. The angle "ø" helps to prevent slipping between a covering and an actual human finger. The second purpose of angle "ø" is to provide a more comfortable fit. This is provided by providing an angle "ø" which is a compromise between the angle naturally formed between an outer and middle phalange, when the hand and fingers are at rest, and the angle formed between these two phalanges when the hand and fingers are gripping an object.

FIG. 4B is an end sectional view of the finger covering 30 of FIG. 4A. As can be seen, the opening is circular to elliptical in shape and can have the following dimensions:

Diameter d1:

Finger covering, ½" to 1⅜"; (preferred for size men's large is 13/16"); and thumb covering, ⅝" to 1½". (preferred for size men's large is 1").

Diameter d2:

Ranging from dimension d1, and tapering down to an elliptical shape, which eventually approaches zero at a closed end.

Thickness:

Thickness "t" will vary throughout the length of a covering. In some areas it may be desired to have a thin covering for the purpose of flexibility and/or tactility. In other areas, it may be desired to have added thickness for the purpose of rigidity and/or insulation. The thickness "t" may range from about 0.003" to about 0.5".

Although the index finger covering 30 and the thumb covering 20 may provide advantages over known glove constructions, for example, by allowing a hand covering wearer to precisely and accurately operate sensitive toggle switches and controls without mistakenly operating adjacent controls, the index finger covering 30 and the thumb covering 20 provide the greatest advantage when used in combination. For example, as is shown in FIG. 3, the index finger covering ridge 34 and the thumb covering ridge 24 may cooperate to facilitate manipulation of small objects, such as a coin 50. The shape of the index finger covering 30 and the thumb covering 20 are important in that they allow a covered hand to operate like an uncovered hand. For example, when manipulating small objects, such as the coin 50, with a bare hand, the fingernail of the index finger serves an important function by being placed under or along side the edge of the coin and cooperating with pressure provided by the thumb or thumbnail. This tactility is commonly lost by conventional glove coverings, but is provided by the ridge 34, the thumb ridge 24 and the particular shape of the index finger covering 30 and the thumb covering 20, which allow the ridges to cooperate in the plane of a flat surface. A preferred combination is to employ a hand covering having a thumb covering 20 and an index finger covering 30. FIGS. 1 and 2 more closely show the thumb and index finger combination. The back of the finger tip covering is relatively planar and the palm side of the finger tip covering is rounded to form ridge 34. This shape allows a gloved hand with a covering on the thumb and the index finger to contact more surface area of the coin 50 (or other small object) than would otherwise be possible with traditional glove coverings. The increase in surface area afforded by the covering of the present invention allows a wearer to exert a normal direction force and side friction direction force on very small objects such as the edge of the coin.

The thumb covering 20 is designed to matingly cooperate with the arching transition section 36. Common glove configurations are often bulky and not shaped like a finger tip, thereby creating losses in tactility. By approximating the shape of the fleshy part of a human finger, the present hand covering allows a covered hand to more closely function like an uncovered hand.

Figure 5:
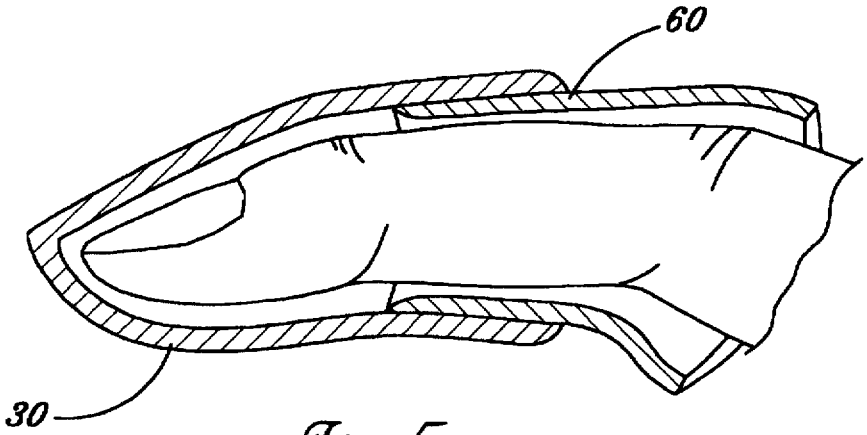
FIGS. 5–8 are views detailing various embodiments of the present invention taken along line A—A of FIG. 2.
Figure 6:
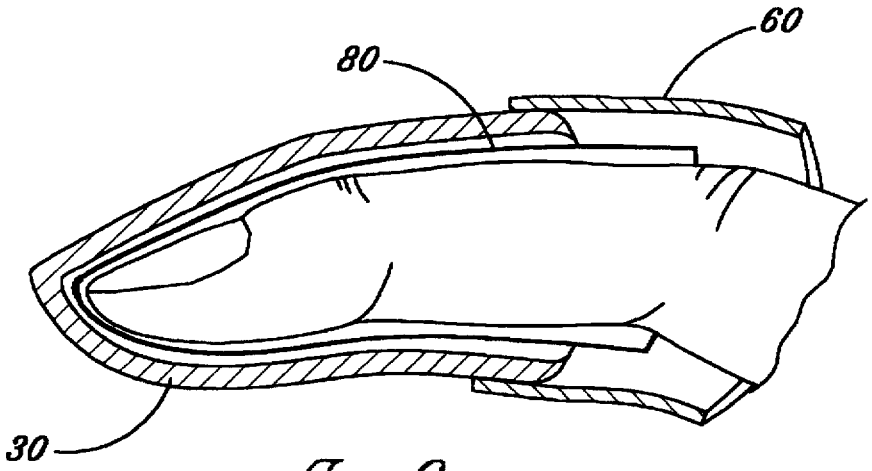
Figure 7:
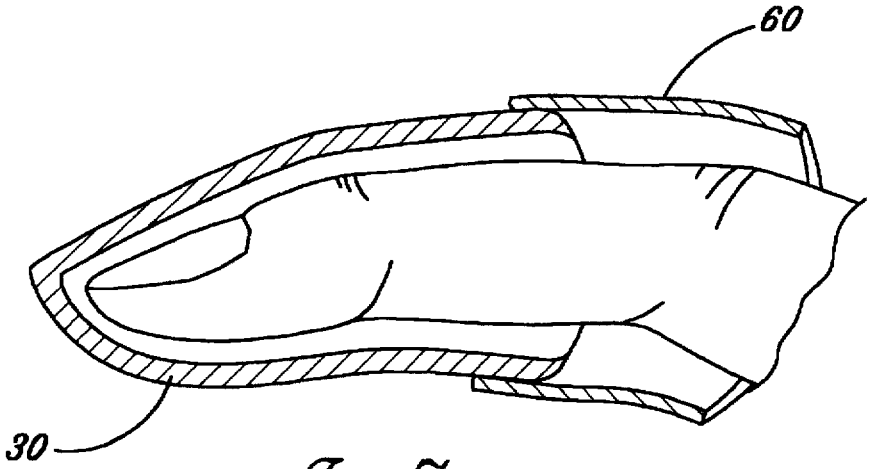
Figure 8:
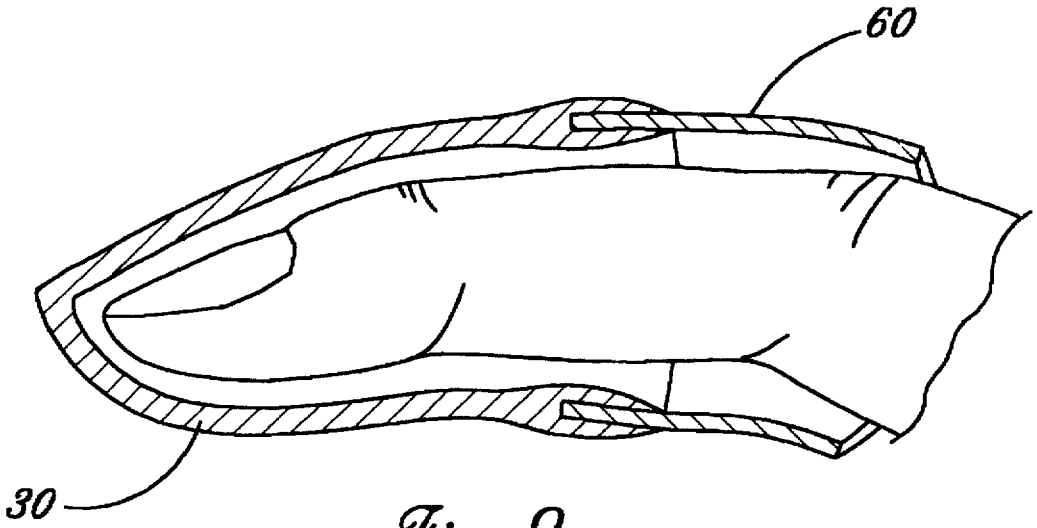

As should be understood, the thumb covering 20 and the index finger covering 30 may be fixedly attached to the hand covering 10 by a variety of methods, a few examples of which are illustrated in FIGS. 5–8. In the method shown in FIGS. 6 and 7, the glove shell 60 overlaps the index finger covering by approximately ¼". The overlap may range from 0 to one inch. In FIG. 5, the glove shell 60 is disposed under the index finger covering 30. FIG. 6 illustrates a finger covering 30 which is disposed over a finger stall of a glove insert 80, and glove shell 60 overlaps finger covering 30 by about ¼". FIG. 8 shows a finger covering 30 and an adjoining glove shell 60, wherein the glove shell or glove insert is encapsulated by the finger covering 30. This may be accomplished by any suitable process, such as by any suitable molding process, for example.

Figure 9:
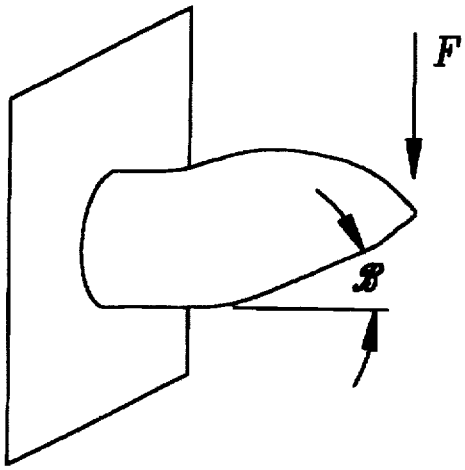
FIG. 9 schematically illustrates that the hand covering of the present invention resisting deformation upon application of a predetermined force "F".

The materials used to make the thumb covering 20 and the index finger covering 30 shall be semi-rigid and moldable. Suitable materials must maintain a defined shape when forces of 0.1 lbs. to 20 lbs. are applied to (or pressed against) the covering surfaces. The amount of force a covering will need to resist will depend on the application within which a hand covering is employed. In this regard and as schematically illustrated in FIG. 9, the deflection of angle "β" on application of force "F" should not change by greater than 5 degrees for the desired application. For example, a glove used to perform computer operations may only need to withstand a pushing force on the finger tips of 0.2 lbs. per finger. Whereas a glove used during fire fighting to open storm windows may need to withstand a pushing force on the finger tips of 7 lbs. per finger. It is desirable to provide the minimum rigidity needed for the application, but not excessive rigidity. This allows for some amount of flexibility which aids the tactility.

In addition to rigidity, it is also desirable for the material to have surface friction properties. The greater the surface friction of a covering, the lower the amount of gripping force required by the hand. By reducing the gripping force required by the hand, the fatigue associated with prolonged and/or repeated tasks can be reduced. The surface friction requirements will vary for different applications. For example, for a pencil to be picked up, a surface friction force must be created which is equal to the weight of the pencil (which is approximately 0.1 lbs.). In the case of picking up a pencil (or a coin), the surface friction force is created by the normal force exerted on the pencil, times the coefficient of friction between the pencil and the surface of the finger tip cover. It should be understood that the coverings described in this invention serve the purpose of increasing the area over which the force can be applied to an object. By increasing the area of contact, the normal force and frictional force is increased, thereby reducing the hand gripping force required to pick up an object. Suitable materials include, but are not limited to, urethanes, polyamides, polyesters, natural rubbers, nitrile, neoprene, vinyl, polyvinyl chloride, butyl, silicone, and polytetrafluoroethylene (PTFE).

Without intending to limit the scope of the present invention, the apparatus and method of production of the present invention may be better understood by referring to the following examples:

EXAMPLE 1

A thumb covering and finger covering were made by pouring a silicone (GE-RTV664 from the General Electric Company) into a two piece block mold. A separate plug was then inserted into the mold opening to displace the silicone in the center area. After curing, the coverings were removed from the mold.

A hand covering was made by applying approximately 0.75 cc of silicone adhesive (obtained from Dow Corning RTV #732) to an outside tip area of both the thumb and first finger stalls of a glove insert. An index finger tip covering was then placed over the thumb and index finger and allowed to adhere.

A glove shell was obtained which was made from a hair sheep leather palm material and a simplex knit fabric. The glove shell was altered by cutting off the outermost phalange of the thumb and first finger.

The glove shell was pulled over the insert. The glove shell overlapped the thumb and index finger coverings by approximately ¼". A bead of silicone adhesive (Dow Corning RTV #732) was applied around the joint between the glove shell and the thumb and index finger coverings and allowed to adhere and cure.

The hand covering was completed by stitching together the insert and the glove shell at the cuff.

The physical properties of the silicone coverings were as follows:

Durometer, Shore-"A": 60;

Tensile Strength: 800 lb./in$^2$;

Elongation: 220%; and

Temperature Resistance: 400° F. constant.

It is anticipated that the hand covering of the present invention may be further improved by making modifications to the rounded area on the palm side of the coverings. For example, a concave indentation could be made in this area to correspond to the rounded head on a toggle switch, or the rounded surface of a turn dial. The radius of the concave area could be made to match the radius of the switch or dial. A further improvement may be made to the diameter at the end of the index finger covering. For example, the diameter at the end of the index finger covering may be made to correspond to the diameter of push buttons used on a phone or radio device. An index finger covering with this improvement could be attached to one designated finger for such functions.

A further improvement may be made to the insulating properties of the coverings. The thickness may be varied to achieve a desired insulation and the material used to achieve the insulation may be varied. For example, the outer surface of the finger tip cover may be made of silicone and be approximately ⅛" in thickness. Inside the index finger covering, an additional felt or flocked insulating material, approximately 1/16" to 3/16" thick, made from cotton, aramid fiber or wool for example, may be added.

Also, on a pair of gloves made in accordance with the present invention, it may be desirable to have a single covering on only one finger of each hand.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. An improved hand covering of the type having an index finger stall, a thumb stall, a palm portion, and a dorsal portion, the improvement comprising:

at least an index finger covering having a main body defined by a predetermined rigidity, a substantially elliptical cross section, an upper portion, a lower portion, a ridge formed from the union of the upper portion and the lower portion, and an arching transition section from the lower portion to the upper portion, said index finger covering having substantially the same shape as a human index finger tip, said main body defining an angle "β" at the junction of said upper and lower portion whereupon application of a force of less than 20 pounds to said upper portion, angle "β" changes by no greater than 5 degrees; and wherein said index finger covering is fixedly attached to the index finger stall, the improved hand covering providing a wearer with improved dexterity and tactility, thereby, allowing the wearer to perform fine motor skill operations.

2. The improved hand covering of claim 1, wherein the index finger covering defines first and second portions, the first portion corresponding to an outer phalange of an index finger, and the second portion corresponding to a middle phalange of said index finger.

3. The improved hand covering of claim 2, wherein the first portion has a predetermined length, and wherein the second portion has a length which is from about ¼ to about 1 times the length of said first portion.

4. The improved hand covering of claim 2, wherein an angle "ø" is defined between an axis substantially parallel to said first portion and an axis substantially parallel to said second portion, wherein the value of angle "ø" ranges from about 120° to about 170°.

5. The improved hand covering of claim 4, wherein the value of angle "ø" is about 150°.

6. The improved hand covering of claim 1, wherein the index finger covering has a wall thickness which ranges from about 0.003 to about 0.5 inches.

7. The improved hand covering of claim 1 further including a thumb covering fixedly attached to the thumb stall.

8. The improved hand covering of claim 7, wherein the thumb covering defines first and second portions, the first portion corresponding to an outermost phalange of a thumb, and the second portion corresponding to a base phalange of said thumb.

9. The improved hand covering of claim 8, wherein the first portion has a predetermined length, and wherein the second portion has a length which is from about ¼ to about 1 times the length of said first portion.

10. The improved hand covering of claim 8, wherein an angle "ø" is defined between an axis substantially parallel to said first portion of said thumb covering and an axis substantially parallel to said second portion of said thumb covering, wherein the value of angle "ø" ranges from about 120° to about 170°.

11. The improved hand covering of claim 10, wherein the value of angle "ø" is about 150°.

12. The improved hand covering of claim 7, wherein the thumb covering has a wall thickness which ranges from about 0.003 to about 0.5 inches.

13. An improved hand covering of the type having an index finger stall, a thumb stall, a palm portion, and a dorsal portion, the improvement comprising:

at least an index finger covering fixedly attached to said index finger stall, said index finger covering having a substantially elliptical cross section, an upper portion, a lower portion, a ridge formed from the union of the upper portion and the lower portion, and an arching transition section from said lower portion to said upper portion, wherein said index finger covering defines substantially the same shape as a human index finger tip; and a thumb covering fixedly attached to the thumb stall, said thumb covering defining first and second portions, said first portion corresponding to an outermost phalange of a thumb, said second portion corresponding to a base phalange of said thumb, wherein an angle "ø" is defined between an axis substantially parallel to said first potion of said thumb covering and an axis substantially parallel to said second portion of said thumb covering, said angle "ø" ranging from about 120° to about 170°;

wherein the improved hand covering provides a wearer with improved dexterity and tactility, thereby, allowing the wearer to perform fine motor skill operations.

14. The improved hand covering of claim 13, wherein the value of angle "ø" is about 150°.

15. The improved hand covering of claim 13, wherein the thumb covering has a wall thickness which ranges from about 0.003 to about 0.5 inches.

16. The improved hand covering of claim 13, wherein the index finger covering has a wall thickness which ranges from about 0.003 to about 0.5 inches.

17. The improved hand covering of claim 13, wherein the index finger covering defines first and second portions, the first portion of said index finger covering corresponding to an outer phalange of an index finger, and the second portion of said index finger covering corresponding to a middle phalange of said index finger.

18. The improved hand covering of claim 17, wherein the first portion of said index finger covering has a predetermined length, and wherein the second portion of said index finger covering has a length which is from about ¼ to about 1 times the length of said first portion.

19. The improved hand covering of claim 17, wherein an angle "ø" is defined between an axis substantially parallel to said first portion of said index finger covering and an axis substantially parallel to said second portion of said index finger covering, wherein the value of angle ø ranges from about 120° to about 170°.

20. The improved hand covering of claim 19, wherein the value of angle "ø" is about 150°.

* * * * *